US011289022B2

(12) United States Patent
Chen et al.

(10) Patent No.: US 11,289,022 B2
(45) Date of Patent: Mar. 29, 2022

(54) PIXEL DRIVING CIRCUIT, METHOD, AND DISPLAY APPARATUS

(71) Applicants: Chongqing BOE Optoelectronics Technology Co., Ltd., Chongqing (CN); BOE TECHNOLOGY GROUP CO., LTD., Beijing (CN)

(72) Inventors: Shuai Chen, Beijing (CN); Zhi Zhang, Beijing (CN); Xiuzhu Tang, Beijing (CN); Shuang Hu, Beijing (CN); Yanan Zhao, Beijing (CN); Chuan Li, Beijing (CN)

(73) Assignees: Chongqing BOE Optoelectronics Technology Co., Ltd., Chongqing (CN); BOE Technology Group Co., Ltd., Beijing (CN)

( * ) Notice: Subject to any disclaimer, the term of this patent is extended or adjusted under 35 U.S.C. 154(b) by 420 days.

(21) Appl. No.: 16/476,688

(22) PCT Filed: Jul. 24, 2018

(86) PCT No.: PCT/CN2018/096802
§ 371 (c)(1),
(2) Date: Jul. 9, 2019

(87) PCT Pub. No.: WO2020/019158
PCT Pub. Date: Jan. 30, 2020

(65) Prior Publication Data

US 2021/0358413 A1 Nov. 18, 2021

(51) Int. Cl.
*G09G 3/3258* (2016.01)
*G09G 3/3291* (2016.01)
*G09G 3/3266* (2016.01)

(52) U.S. Cl.
CPC ..... *G09G 3/3258* (2013.01); *G09G 3/3266* (2013.01); *G09G 3/3291* (2013.01);
(Continued)

(58) Field of Classification Search
CPC ... G09G 3/3258; G09G 3/3266; G09G 3/3291
See application file for complete search history.

(56) References Cited

U.S. PATENT DOCUMENTS 7,511,708 B2 * 3/2009 Numao ..... G09G 3/3233 345/204
7,663,615 B2 * 2/2010 Shirasaki ..... G09G 3/325 345/204
7,760,168 B2 * 7/2010 Ogura ..... G09G 3/3233 345/77
7,825,879 B2 * 11/2010 Yamashita ..... G09G 3/3233 345/76
7,948,456 B2 * 5/2011 Yamashita ..... G09G 5/18 345/82

(Continued)

*Primary Examiner* — Sardis F Azongha
(74) *Attorney, Agent, or Firm* — Intellectual Valley Law, P.C.

(57) ABSTRACT

The present application discloses a pixel driving circuit. The circuit includes an input sub-circuit configured to set a voltage level at a first node; a storage sub-circuit coupled between the first node and a second node; and a drive sub-circuit coupled to the first node and the second node and configured to drive light emission of a light-emitting device. Additionally, the circuit includes a charge sub-circuit coupled to the drive sub-circuit, and configured to charge the drive sub-circuit to latch a voltage level at the second node to be larger than a first threshold but smaller than a second threshold. Furthermore, the circuit includes an adjust sub-circuit coupled to a second node and coupled to the input sub-circuit at least via the first node, and configured to at least adjust voltage level at the second node to make the light-emitting device with an inverted polarity in one partial period.

20 Claims, 5 Drawing Sheets

(52) U.S. Cl.
CPC ..... *G09G 2300/0426* (2013.01); *G09G 2300/0823* (2013.01); *G09G 2330/021* (2013.01)

(56) References Cited

U.S. PATENT DOCUMENTS

| | | | | |
|---|---|---|---|---|
| 8,599,186 | B2 * | 12/2013 | Ogura | G09G 3/3291 345/211 |
| 10,019,943 | B2 * | 7/2018 | Wu | G09G 3/3233 |
| 10,453,398 | B2 * | 10/2019 | Kishi | G09G 3/3291 |
| 2006/0244688 | A1 * | 11/2006 | Ahn | G09G 3/3233 345/76 |
| 2007/0115225 | A1 * | 5/2007 | Uchino | G09G 3/3233 345/76 |
| 2007/0126680 | A1 * | 6/2007 | Han | G09G 3/3233 345/92 |
| 2011/0090208 | A1 * | 4/2011 | Long | G09G 3/3233 345/211 |

* cited by examiner

PIXEL DRIVING CIRCUIT, METHOD, AND DISPLAY APPARATUS

CROSS-REFERENCE TO RELATED APPLICATION

This application is a national stage application under 35 U.S.C. § 371 of International Application No. PCT/CN2018/096802, filed Jul. 24, 2018, the contents of which are incorporated by reference in the entirety.

TECHNICAL FIELD

The present invention relates to display technology, more particularly, to a pixel driving circuit, a display apparatus, and a method for driving the pixel driving circuit.

BACKGROUND

Modern display apparatus based on light-emitting device (LED) typically uses a transistor-based driving circuit to drive light emission of the light-emitting device. The transistor-based driving circuit employs amorphous silicon based thin-film transistors or metal-oxide thin-film transistors which are manufactured directly on a display panel. Although these thin-film transistors (TFT) can be made on the display panel with substantially uniform electric properties, long-time operation of these TFTs under a bias voltage may cause threshold voltages of the TFTs to drift, resulting luminance decay of the display panel. An alternative choice of low-temperature-poly-silicon thin-film transistor LTPS-TFT may be more stable in its electric property but are hardly made into a large display panel uniformly, causing non-uniformity in luminance of the display panel.

Additionally, organic light-emitting diode (OLED) has be employed as the LED element for each subpixel in the display panel. The OLED device driven by a positive DC current can result in a directional motion of ionic impurities in the organic layer to induce an internal electrical field which reduces an effective electrical field for injecting carriers. Effectively this leads to increase of a threshold voltage of the OLED. Eventually, higher threshold voltage deteriorates the OLED performance, resulting a shortened lifetime of the device. Conventional pixel driving circuit does not have functions of compensating the threshold voltages of both the TFTs and the OLED to achieve satisfying luminance uniformity of the display panel.

SUMMARY

In an aspect, the present disclosure provides a pixel driving circuit for driving light emission in a display panel. The pixel driving circuit includes an input sub-circuit configured to set a voltage level at a first node based on a data voltage. The pixel driving circuit further includes a storage sub-circuit coupled between the first node and a second node to maintain a voltage difference. Additionally, the pixel driving circuit includes a drive sub-circuit coupled to the first node and the second node. The drive sub-circuit is configured to provide a drive current via the second node to a light-emitting device in the display panel to drive light emission in one of multiple periods of each cycle of displaying a frame of pixel image. Furthermore, the pixel driving circuit includes a charge sub-circuit coupled to the drive sub-circuit. The charge sub-circuit is configured to charge the drive sub-circuit to latch a voltage level at the second node to be larger than a first threshold voltage but smaller than a second threshold voltage. Moreover, the pixel driving circuit includes an adjust sub-circuit coupled to a second node and coupled to the input sub-circuit at least via the first node. The adjust sub-circuit is configured to at least adjust voltage level at the second node to make the light-emitting device with an inverted polarity in one of multiple periods of each cycle of displaying a frame of pixel image.

Optionally, the input sub-circuit includes a first transistor coupled between a data line and the first node under control of a first control signal from a first scan line. The adjust sub-circuit includes a second transistor coupled between a third node and the first node under control of a second control signal from a second scan line and a third transistor coupled between the data line and the second node under control of the second control signal. The charge sub-circuit includes a fourth transistor coupled to a power supply line and the third node under control of a third control signal from the control line. The drive sub-circuit includes a fifth transistor coupled to the third node and the second node under control of a voltage level at the first node. The storage sub-circuit includes a capacitor coupled between the first node and the second node. The second node is connected to an anode of the light-emitting device.

Optionally, the first transistor includes a gate electrode coupled to the first scan line, a drain electrode coupled to the data line, and a source electrode coupled to the first node. The second transistor includes a gate electrode coupled to the second scan line, a drain electrode coupled to the third node, and a source electrode coupled to the first node. The third transistor includes a gate electrode coupled to the second scan line, a drain electrode coupled to the data line, and a source electrode coupled to the second node. The fourth transistor includes a gate electrode coupled to the control line, a drain electrode coupled to the power supply line, and a source electrode coupled to the third node. The fifth transistor includes a gate electrode coupled to the first node, a drain electrode coupled to the third node, and a source electrode coupled to the second node.

Optionally, the input sub-circuit includes a first transistor coupled between a data line and the first node under control of a first control signal from a first scan line. The adjust sub-circuit includes a second transistor coupled between a power supply line and the first node under control of a second control signal from a second scan line and a third transistor coupled between the data line and the second node under control of the second control signal The charge sub-circuit includes a fourth transistor coupled to the power supply line and a third node under control of a third control signal from a control line. The drive sub-circuit includes a fifth transistor coupled to the third node and the second node under control of a voltage level at the first node. The storage sub-circuit includes a capacitor coupled between the first node and the second node. The second node is connected to an anode of the light-emitting device.

Optionally, the first transistor includes a gate electrode coupled to the first scan line, a drain electrode coupled to the data line, and a source electrode coupled to the first node. The second transistor includes a gate electrode coupled to the second scan line, a drain electrode coupled to the power supply line, and a source electrode coupled to the first node. The third transistor includes a gate electrode coupled to the second scan line, a chain electrode coupled to the data line, and a source electrode coupled to the second node. The fourth transistor includes a gate electrode coupled to the control line, a drain electrode coupled to the power supply line, and a source electrode coupled to the third node. The fifth transistor includes a gate electrode coupled to the first node, a drain electrode coupled to the third node, and a source electrode coupled to the second node.

Optionally, each of the first transistor, the second transistor, the third transistor, the fourth transistor and the fifth transistor is a same type, either an N-type transistor or a P-type transistor.

Optionally, the light-emitting device is an organic light-emitting diode.

In another aspect, the present disclosure provides a display apparatus including a display panel and the pixel driving circuit described herein.

Optionally, the pixel driving circuit includes a data line, a first scan line, a second scan line, a control line, a power supply line. The input sub-circuit includes a first transistor coupled between the data line and a first node under control of a first control signal from the first scan line. The adjust sub-circuit includes a second transistor coupled between a third node and the first node under control of a second control signal from the second scan line and a third transistor coupled between the data line and a second node under control of the second control control signal. The charge sub-circuit includes a fourth transistor coupled to the power supply line and the third node under control of a third control signal from the control line. The drive sub-circuit includes a fifth transistor coupled to the third node and the second node under control of a voltage level at the first node. The storage sub-circuit comprises a capacitor coupled between the first node and the second node. The second node is connected to an anode, of the light-emitting device.

Optionally, the first transistor includes a gate electrode coupled to the first scan line, a drain electrode coupled to the data line, and a source electrode coupled to the first node. The second transistor includes a gate electrode coupled to the second scan line, a drain electrode coupled to the third node, and a source electrode coupled to the first node. The third transistor includes a gate electrode coupled to the second scan line, a drain electrode coupled to the data line, and a source electrode coupled to the second node. The fourth transistor includes a gate electrode coupled to the control line, a drain electrode coupled to the power supply line, and a source electrode coupled to the third node. The fifth transistor includes a gate electrode coupled to the first node, a drain electrode coupled to the third node, and a source electrode coupled to the second node.

Optionally, each of the first transistor, the second transistor, the third transistor, the fourth transistor and the fifth transistor is either an N-type transistor or a P-type transistor.

Optionally, the pixel driving circuit includes a data line, a first scan line, a second scan line, a control line, a power supply line. The input sub-circuit includes a first transistor coupled between the data line and a first node under control of a first control signal from the first scan line. The adjust sub-circuit includes a second transistor coupled between the power supply line and the first node under control of a second control signal from the second scan line and a third transistor coupled between the data line and a second node under control of the second control signal. The charge sub-circuit includes a fourth transistor coupled to the power supply line and the third node under control of a third control signal from the control line. The drive sub-circuit includes a fifth transistor coupled to the third node and the second node under control of a voltage level at the first node. The storage sub-circuit includes a capacitor coupled between the first node and the second node. The second node is connected to an anode of the light-emitting device.

Optionally, the first transistor includes a gate electrode coupled to the first scan line, a drain electrode coupled to the data line, and a source electrode coupled to the first node. The second transistor includes agate electrode coupled to the second scan line, a drain electrode coupled to the power supply line, and a source electrode coupled to the first node. The third transistor includes a gate electrode coupled to the second scan line, a drain electrode coupled to the data line, and a source electrode coupled to the second node. The fourth transistor includes a gate electrode coupled to the control line, a drain electrode coupled to the power supply line, and a source electrode coupled to the third node. The fifth transistor comprises a gate electrode coupled to the first node, a drain electrode coupled to the third node, and a source electrode coupled to the second node.

Optionally, the display panel is an organic light-emitting diode display panel, and the light-emitting device is an organic light-emitting diode.

In yet another aspect, the present disclosure provides a method of driving a light-emitting element associated with a subpixel of a display panel to emit light in one cycle for displaying one frame of pixel image. The method includes setting a voltage level at an anode of the light-emitting element to be lower than that at a cathode of the light-emitting element to make the light-emitting element with inverted polarity. The method further includes adjusting the voltage level to be greater than an absolute value of a first threshold voltage of a driving transistor coupled to the anode but smaller than an absolute value of a second threshold voltage of the light-emitting element. Additionally, the method includes charging the anode to change the voltage level at the anode based on the first threshold voltage. Furthermore, the method includes updating the voltage level at the anode based on an inputting data voltage to further subtract a coupling voltage resulted from a fixed capacitor connected in series with an effective capacitor associated with the light-emitting element. Moreover, the method includes generating a driving current through the driving transistor being independent from the first threshold voltage and the second threshold voltage to drive light emission of the light-emitting element.

Optionally, the method includes operating a pixel driving circuit coupled to the anode of the light-emitting element to drive light emission of the light-emitting element in one cycle including sequentially an inversion recovery period, a voltage adjustment period, a threshold-voltage latch period, a data-voltage input period, and an emission period. The pixel driving circuit includes a data line, a first scan line, a second scan line, a control line, a power supply line, a capacitor coupled between a first node and a second node, the second node being coupled to an anode of a light emitting element. The pixel driving circuit also includes a first transistor coupled between the data line and the first node, the first transistor being under control of a first control signal from the first scan line; a second transistor coupled between a third node and the first node, the second transistor being under control of a second control signal from the second scan line; a third transistor coupled between the data line and a second node. The third transistor is under control of the second control signal from the second scan line. The pixel driving circuit additionally includes a fourth transistor and a fifth transistor coupled to each other in series via the third node between the power supply line and the second node. The fourth transistor is controlled by a third control signal from the control line and the fifth transistor is the driving transistor controlled by a voltage level at the first node. The method further includes generating a voltage level at the second node such as to make the light-emitting element with inverted polarity at least in the inversion recovery period.

Optionally, in the inversion recovery period, the method further includes setting the first control signal to a turn-off voltage level to turn off the first transistor; setting the second control signal to a turn-on voltage level to turn on the second transistor and the third transistor setting the third control signal to a turn-on voltage level to turn on the fourth transistor; and supplying a data voltage being a negative level to the data line. The first node is set to a voltage level from the power supply line and the second node is set to a voltage level of the data voltage.

Optionally, in the voltage adjustment period following the inversion recovery period, the method includes setting the second control signal to the turn-off voltage level to turn off the second transistor and the third transistor; setting the first control signal to the turn-on voltage level to turn on the first transistor slightly after setting the second control signal to the turn-off voltage level; keeping the third control signal at the turn-on voltage level to maintain the fourth transistor on; and supplying the data voltage at a different voltage level to the data line slightly after setting the second control signal to the turn-off voltage level.

Optionally, in the threshold-voltage latch period following the voltage adjustment period, the method includes keeping the first control signal to be the turn-on voltage level to keep the first transistor on; keeping the second control signal to be the turn-off voltage level to turn off the second transistor and the third transistor; setting the third control signal to the turn-on voltage level to turn on the fourth transistor; and keeping the data voltage unchanged.

Optionally, in the data-voltage input period following the threshold-voltage latch period, the method includes keeping the first control signal to be the turn-on voltage level to keep the first transistor on; keeping the second control signal to be, the tum-off voltage level to keep the second transistor and the third transistor off; setting the third control signal to the turn-off voltage level to turn off the fourth transistor; and supplying the data voltage with another different voltage level to the data line slightly after setting the third control signal to the turn-off voltage level.

Optionally, in the emission period following the data-voltage input period, the method includes setting the third control signal to the turn-on voltage level to turn on the fourth transistor; keeping the second control signal to be the turn-off voltage level to keep the second transistor and the third transistor off; setting the first control signal to the turn-off voltage level to turn off the first transistor slightly ahead of setting the third control signal to the turn-on voltage level to turn on the fourth transistor; and generating a drive current through the fifth transistor via the second node to the anode of the light-emitting element. The drive current is independent of the first threshold voltage and the second threshold voltage.

Optionally, each of the first transistor, the second transistor, the third transistor, the fourth transistor and the fifth transistor is a same type, either an N-type transistor or a P-type transistor, and the light-emitting element is an organic light-emitting diode.

Optionally, the method further includes operating a pixel driving circuit coupled to the anode of the light-emitting element to drive light emission of the light-emitting element in one cycle including sequentially an inversion recovery period, a voltage adjustment period, a threshold-voltage latch period, a data-voltage input period, and an emission period. The pixel driving circuit includes a data line, a first scan line, a second scan line, a control line, a power supply line. Further, the pixel driving circuit includes a capacitor coupled between a first node and a second node, the second node being coupled to an anode of a light emitting element; a first transistor coupled between the data line and the first node; the first transistor being under control of a first control signal from the first scan line; a second transistor coupled between the power supply line and the first node. The second transistor is under control of a second control signal from the second scan line. The pixel driving circuit additionally includes a third transistor coupled between the data line and a second node. The third transistor is under control of the second control signal from the second scan line. Furthermore, the pixel driving circuit includes a fourth transistor and a fifth transistor coupled to each other in series via the third node between the power supply line and the second node. The fourth transistor is controlled by a third control signal from the, control line and the fifth transistor is the driving transistor controlled by a voltage level at the first node. The method further includes generating a voltage level at the second node such as to make the light-emmitting element with inverted polarity at least in the inversion recovery period.

Optionally, in the inversion recovery period, the method further includes setting the first control signal to a turn-off voltage level to turn off the first transistor; setting the second control signal to a turn-on voltage level to turn on the second transistor and the third transistor; setting the third control signal to a turn-off voltage level to turn off the fourth transistor; and supplying a data voltage being a negative level to the data line. The first node is set to a voltage level from the power supply line and the second node is set to a voltage level of the data voltage.

BRIEF DESCRIPTION OF THE FIGURES

The following drawings are merely examples for illustrative purposes according to various disclosed embodiments and are not intended to limit the scope of the present invent on.

DETAILED DESCRIPTION

The disclosure will now be described more specifically with reference to the following embodiments. It is to be noted that the following descriptions of some embodiments are presented herein for purpose of illustration and description only. It is not intended to be exhaustive or to be limited to the precise form disclosed.

Organic light-emitting diode (OLED) has be employed as the LED element for each subpixel in the display panel. The OLED device driven by a positive DC current can result in a directional motion of ionic impurities in the organic layer to induce an internal electrical field which reduces an effective electrical field for injecting carriers. Effectively this leads to increase of a threshold voltage of the OLED. Eventually, higher threshold voltage deteriorates the OLED performance, resulting a shortened lifetime of the device.

Figure 1:
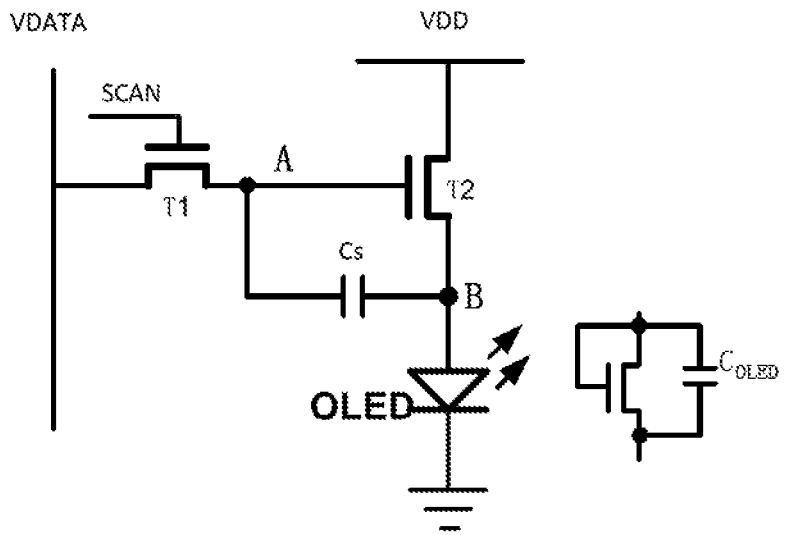
FIG. 1 (related art)
FIG. 1 is conventional pixel driving circuit with 2T1C structure.

Conventional pixel driving circuit does not have functions of compensating the threshold voltages of both the TFTs and the OLED to achieve satisfying luminance uniformity of the display panel. FIG. 1 is conventional pixel driving circuit with 2T1C structure associated with a subpixel in a display panel. Referring to FIG. 1, when the scan line (SCAN) for the particular subpixel is selected to apply a turn-on voltage, a first transistor T1 is turned on. A voltage signal VDATA is written via the first transistor T1 to a node A of a storage capacitor Cs (i.e., the voltage is stored effective through the capacitance of the capacitor Cs which is coupled to another node B). As the first transistor T1 is worked in a non-saturation state, a second transistor T2 is configured to have its gate coupled to the node A and a source coupled to the node B with a gate-source voltage Vgs to be equal to the VDATA. When the scan line SCAN is not selected, T1 is turned off. The voltage stored by the capacitor Cs is able to turn the second transistor T2 on. Further, the second transistor T2 generates a current (from its drain to source) to drive the OLED device to emit light for lighting the subpixel. The second transistor T2 is configured to be operated in a saturation state so that the drain current is determined by $$I_{DS} = \frac{1}{2}\mu_n C_{OX}\frac{W}{L}(V_{gs} - V_{th})^2, \tag{1}$$

where $\mu_n$ is an electron carrier mobility of the TFT (i. e. T2), $C_{OX}$ is an insulation capacitance of a unit area, W/L is a width-to-length ratio of the driving TFT T2, Vgs is the gate-source voltage of the TFT T2, and Vth is a threshold voltage of the TFT T2. The drain current is the current flowing through the OLED which is directly coupled to the node B which is the source of the TFT T2. Based on formula (1), the current flowing through the OLED is highly depended upon the threshold voltage Vth of the TFT.

Figure 2:
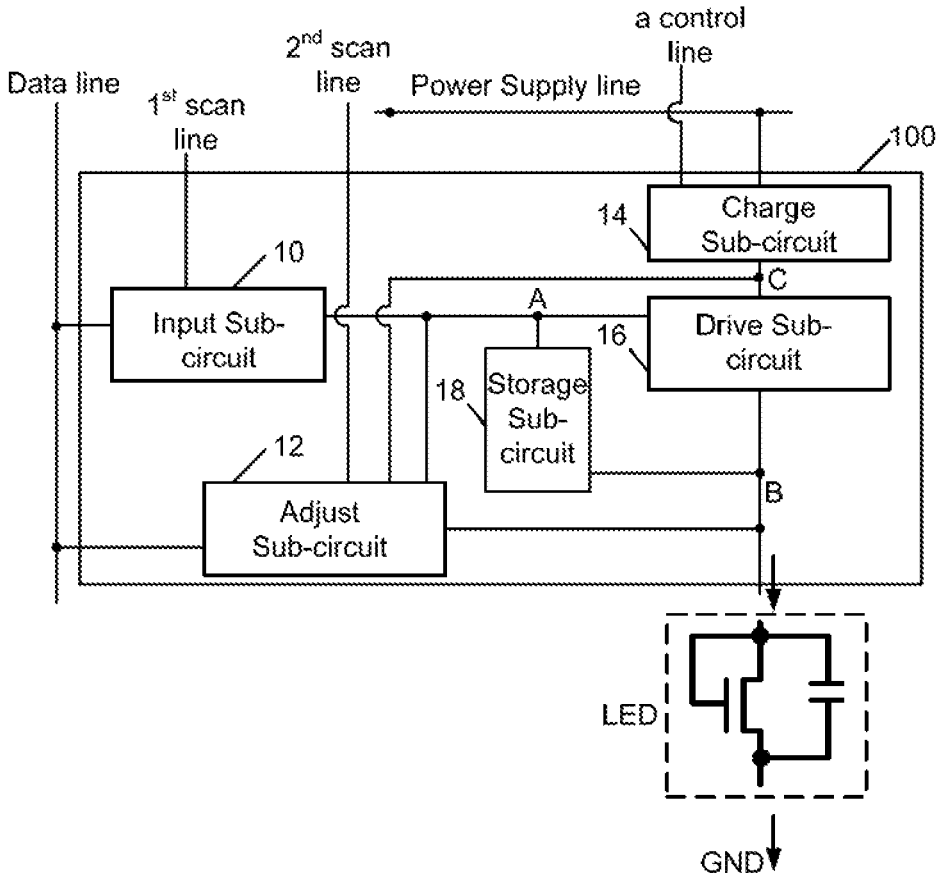
FIG. 2 is a block diagram of a pixel driving circuit according to some embodiments of the present disclosure.

Accordingly, the present disclosure provides, inter alia, a pixel driving circuit, a display apparatus, and a method of driving the pixel driving circuit thereof that substantially obviate one or more of the problems due to limitations and disadvantages of the related art. In one aspect, the present disclosure provides a pixel driving circuit for driving light emission of a light-emitting device associated with a subpixel of a display panel. FIG. 2 is a block diagram of a pixel driving circuit according to some embodiments of the present disclosure.

Referring to FIG. 2, the pixel driving circuit 100 includes an input sub-circuit 10, an adjust sub-circuit 12, a charge sub-circuit 14, a drive sub-circuit 16, and a storage sub-circuit 18. In some embodiments, the input sub-circuit 10 is coupled to a data line and a first node A and has a control terminal coupled to a first scan line. The input sub-circuit 10 is configured to write whatever voltage level provided in the data line to the first node A under control of a first control signal supplied to the first scan line. The adjust sub-circuit 12 is coupled respectively to the data line, a second node B, and a third node C, and has a control terminal coupled to a second scan line to receive a second control signal. The adjust sub-circuit 12 is configured to adjust the voltage level at the first node A and pass a first voltage level from the data line to the second node B. The second node B, as shown, is intended to couple with a light-emitting device LED. Optionally, the LED is a light-emitting element associated with a subpixel in a display panel. In particular, the second node B is coupled to an anode of the LED which is depicted as a transistor (with shared gate electrode and drain electrode) coupled in parallel with an effective capacitor. The LED has a cathode configured to be provided with a common voltage (e.g., connected to ground). Alternatively, the adjust sub-circuit 12 is also configured to pass a voltage level from the third node C to the first node A to at least adjust the voltage level of the first node A which may be preset by the input sub-circuit 10.

In an alternative embodiment, the adjust sub-circuit 12 is coupled respectively to the data line, a power-supply line, and the second node B, and has a control terminal coupled to the second control line to receive the second control signal. Additionally, the adjust sub-circuit 12 is also configured to pass a power-supply voltage from the power-supply line to the first node A to at least adjust the voltage level of the first node A which may be preset by the input sub-circuit 10.

Referring to FIG. 2 again, the charge sub-circuit 14 is coupled via the third node C with the drive sub-circuit 16 in series. The charge sub-circuit 14 has one terminal coupled to the power supply line and another terminal (i.e., the third node C) coupled to the drive sub-circuit 16. The drive sub-circuit 16 further has another terminal coupled to the second node B. The drive sub-circuit 16 is configured to provide a driving current via the second node B to the LED in the display panel to drive light emission. The charge sub-circuit 14 is configured to charge the drive sub-circuit 16 to latch a voltage level at the second node B to be larger than a first threshold voltage but smaller than a second threshold voltage. Both the first threshold voltage and the second threshold voltage are characterized physical properties respectively associated with a driving transistor in the drive sub-circuit 16 and the LED. Further, referring to FIG. 2, the storage sub-circuit 18 is coupled between the first node A and the second node B to maintain a voltage difference in between.

In some embodiment, the pixel driving circuit 100 is configured to generate the driving current from the drive sub-circuit 16 to flow through the LED at least in one of multiple periods of one cycle of displaying a frame of pixel image. The LED device is associated with a subpixel in a display panel. Optionally, the driving current is associated with the driving transistor working in a saturation state. The driving current is substantially independent from the first threshold voltage of the driving transistor and the second threshold voltage of the LED device. Additionally, the pixel driving circuit 100 is also configured to adjust the voltage level at the second node B, which is also connected to the anode of the LED, to be lower than that of the cathode of the LED so that the LED is set to a state with inverted polarity at least in another of multiple periods of the cycle of displaying a frame of pixel image. The inverted polarity of LED occasionally helps to suppress an electrical field in the LED induced by increasing number of ionic impurities under a long-time bias voltage.

Figure 3:
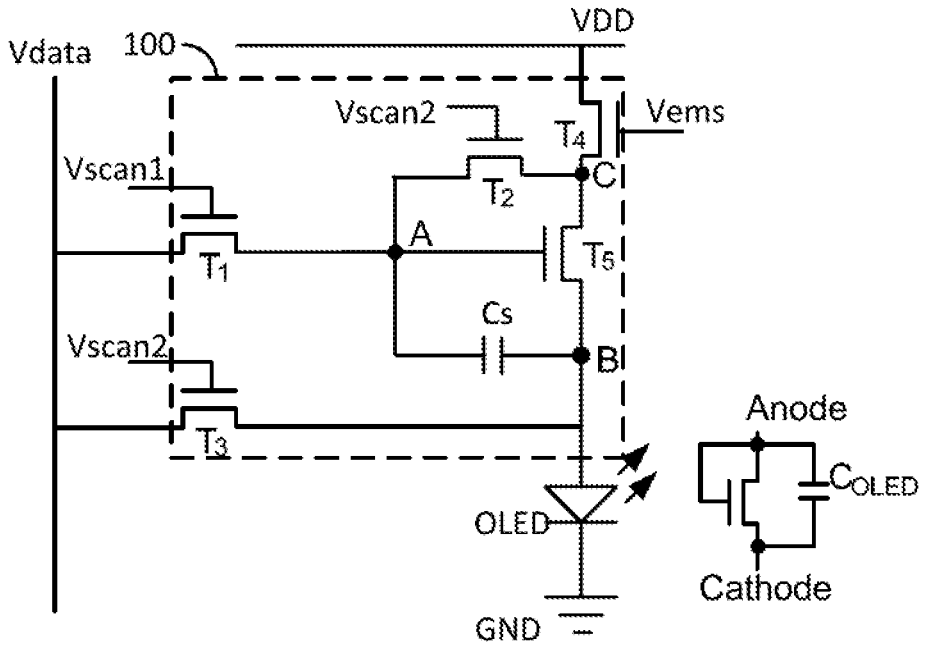
FIG. 3 is a pixel driving circuit comprising a 5T1C structure according to an embodiment of the present disclosure.

FIG. 3 is a pixel driving circuit comprising a 5T1C structure according to an embodiment of the present disclosure. This is an example of the pixel driving circuit 100. Referring to FIG. 3, the input sub-circuit 10 of FIG. 2 includes a first transistor T1 with a gate electrode connected to a first scan line, a drain electrode connected to the data line Vdata, and a source electrode coupled to the, first node A. The first transistor T1 is a switch transistor for connecting the data line Vdata to pass a voltage programmed in Vdata to set or change, a voltage level at the first node A under control of a first control signal Vscan1 supplied to the first scan line.

In this example, the adjust sub-circuit 12 of FIG. 2 includes two transistors, a second transistor T2 and a third transistor T3. The second transistor T2 has a gate electrode coupled to a second scan line, a drain electrode coupled to a power supply line, and a source electrode coupled to the first node A. The second transistor T2 is a switch transistor for connecting the third node C to reset or adjust the voltage level at the first node A under control of a second control signal Vscan2 supplied to the second scan line. The third transistor T3 has a gate electrode also coupled to the second scan line, a drain electrode coupled to the data line Vdata, and a source electrode coupled to the second node B. The third transistor T3 is also a switch transistor for connecting the data line Vdata to set or adjust a voltage level at the second node B under control of the second control signal Vscan2 from the second scan line.

Additionally, in this example the charge sub-circuit 14 of FIG. 2 includes a fourth transistor T4 and is connected to the drive sub-circuit 16 of FIG. 2 including a fifth transistor T5 served as a driving transistor. The fourth transistor T4 is a switch transistor with a gate electrode coupled to a control line, a drain electrode coupled to the power supply line, and a source electrode connected to the third node C and further connected in series to a drain electrode of the fifth transistor T5.

In general, all transistors herein are configured in thin-film transistors or field-effect transistors with a control terminal or gate electrode and substantially made symmetrically for source electrode and drain electrode. Each of these transistors is also configured to be a switch transistor with an ON state by a turn-on voltage applied to the control terminal or gate electrode or an OF state by a turn-off voltage applied to the gate electrode. For N-type transistor, the turn-on voltage is a high voltage level and the turn-off voltage is a low voltage level.

Referring to FIG. 3, the fifth transistor T5 has a gate electrode coupled to the first node A, a drain electrode coupled to the third node C, and the source electrode coupled to the second node B, which is configured in a saturation state to be controlled by the voltage level at the first node to generate a driving current to drive the LED device. The fourth transistor T4 at an ON state is to connect the power supply line (supplied with VDD) to the third node C. If the second transistor T2 is also at an ON state, the first node A can be written into the power supply voltage VDD from the power supply line to turn on the fifth transistor T5. An ON state of T5 allows the power supply voltage VDD to charge the second node B through the fifth transistor T5. Optionally, all the transistors in the pixel driving circuit 100 can be replaced by P-type transistors. Optionally, the power supply voltage VDD may be supplied with different levels, such as VDD1, VDD2, or VDD3, depending on different periods in an operation cycle, especially for operating the pixel driving circuit 100 with all transistors in P-type (to be shown below).

Furthermore, in this example the storage sub-circuit 18 of FIG. 2 includes a storage capacitor Cs having a first electrode coupled to the first node A and a second electrode coupled to the second node B. The storage capacitor Cs is used to maintain a voltage difference between the first node A and the second node B to at least latch a value of the first threshold voltage Vth of the fifth transistor T5.

In an embodiment, each of the first transistor T1, the second transistor T2, the third transistor T3, the fourth transistor T4, and the fifth transistor, i.e., the driving transistor T5 is air N-type transistor. Optionally, the LED device is an organic light-emitting diode (OLED). Optionally, the pixel driving circuit 100 is formed in an OLED display panel. In an alternative embodiment, with proper adjustment of transistor and OLED positions in the pixel driving circuit, each transistor may be replaced by a P-type transistor. For P-type transistor a turn-on voltage is a low voltage level and a turn-off voltage is a high voltage level applied to corresponding gate electrode.

Referring to FIG. 3, in this example, the pixel driving circuit 100 containing five transistors and one capacitor (5T1C) circuitry structure is coupled to an organic light-emitting diode (OLED) associated with one subpixel in the display panel. In particular, the second node B is coupled to an anode of the OLED. The OLED has a cathode configured to be provided with a common voltage (e.g., being grounded). Effectively, the OLED is described by a transistor (with shared gate electrode and drain electrode) connected in parallel with an effective capacitor $C_{OLED}$. The pixel driving circuit 100 is operated to generate a driving current from the driving transistor T5 to its source electrode which is also the second node B, giving a certain voltage level Voled relative to the common voltage (e.g., ground) at the second node B or at the anode of the OLED. As the driving current is large enough when the voltage level Voled is over a second threshold voltage Vth_oled of the OLED, it flows through the OLED and drive the OLED associated with the subpixel to emit light for producing a pixel image in each cycle. Here, one cycle refers to an operation time in which the subpixel located in one row of a plurality of subpixels in the display panel is just being scanned through a progressive scanning process for displaying a name of image in the display panel.

In order to operate the pixel driving circuit 100 to generate the driving current to drive light emission of the OLED in each cycle of displaying a frame of pixel image, the pixel driving circuit 100 further includes a (connection to) data line supplied with a data voltage Vdata, a first scan line supplied with a first scan signal Vscan1, a second scan line supplied with a second scan signal Vscan2, a control line supplied with a control signal Vems, and a power supply line supplied with a positive voltage VDD. Optionally, VDD may vary with different values, such as VDD1<VDD2<VDD3. In particular, each of the scan or control signals, Vscan1, Vscan2, and Vems, is either given as a low voltage level or a high voltage level in one or more periods of each cycle. Optionally, the low voltage level corresponds to a control signal that is able to turn off an N-type switch transistor or turn on a P-type transistor. Optionally, the high voltage level corresponds to a control signal turning on an N-type thin-film transistor (TFT) or turning off a P-type TFT in the pixel driving circuit. In an embodiment, the pixel driving circuit 100 is to program each of the first control signal Vscan1, the second control signal Vscan2, and the third control signal Vems in selective low or high voltage levels in different periods in each cycle. Further, the data voltage Vdata supplied to the data line is programmed such as it can be either negative or positive in the corresponding different periods of the each cycle. By operating the pixel driving circuit 100 under the selected control signals and programmed data voltage level, the OLED can be driven to emit light in one period of each cycle by a driving current that is independent of the first threshold voltage of the driving transistor and the second threshold voltage of the OLED. Additionally, in at least another period of each cycle, a specific type of LED device, an organic light-emitting diode (OLED), can be set into a state with inverted polarity for preventing space charge accumulation within organic layer of the OLED, thereby enhancing its lifetime.

In another aspect, the present disclosure provides a method for driving a light-emitting element associated with a subpixel of a display panel to emit light in one cycle for displaying one frame of pixel image. an embodiment, the method of driving a light-emitting element in the display panel includes setting a voltage level at an anode of the light-emitting element to a first voltage level for inverting polarity of the light-emitting element. The method further includes adjusting the voltage level to an absolute value greater than an absolute value of a first threshold voltage of a driving transistor but smaller than a second threshold voltage of the light-emitting element. The first threshold voltage is associated with a driving transistor used in a pixel driving circuit. Optionally the pixel driving circuit is the same as the pixel driving circuit 100 shown in FIG. 3 that is coupled to the light-emitting diode in series. The second threshold voltage is associated with the light-emitting element. Optionally, the light-emitting element is an organic light-emitting diode. Additionally, the method includes changing the voltage level to a second voltage level subtracting the first threshold voltage. Furthermore, the method includes updating the voltage level based on an inputting data voltage at a third voltage level subtracting a coupling voltage resulted from a fixed capacitor connected in series with an effective capacitor associated with the light-emitting element. Moreover, the method includes generating a driving current independent from the first threshold voltage and the second threshold voltage to drive light emission of the light-emitting element.

Figure 4:
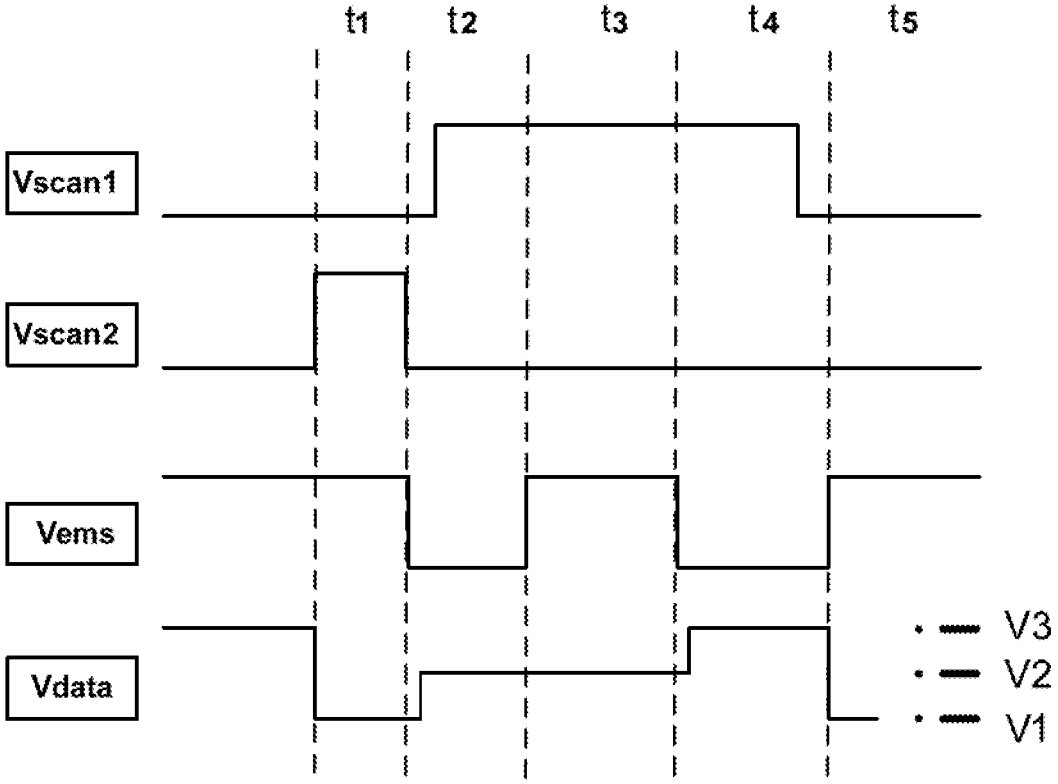
FIG. 4 is a timing diagram of operating the pixel driving circuit of FIG. 3 with all N-type transistors according to an embodiment of the present disclosure.
Figure 5:
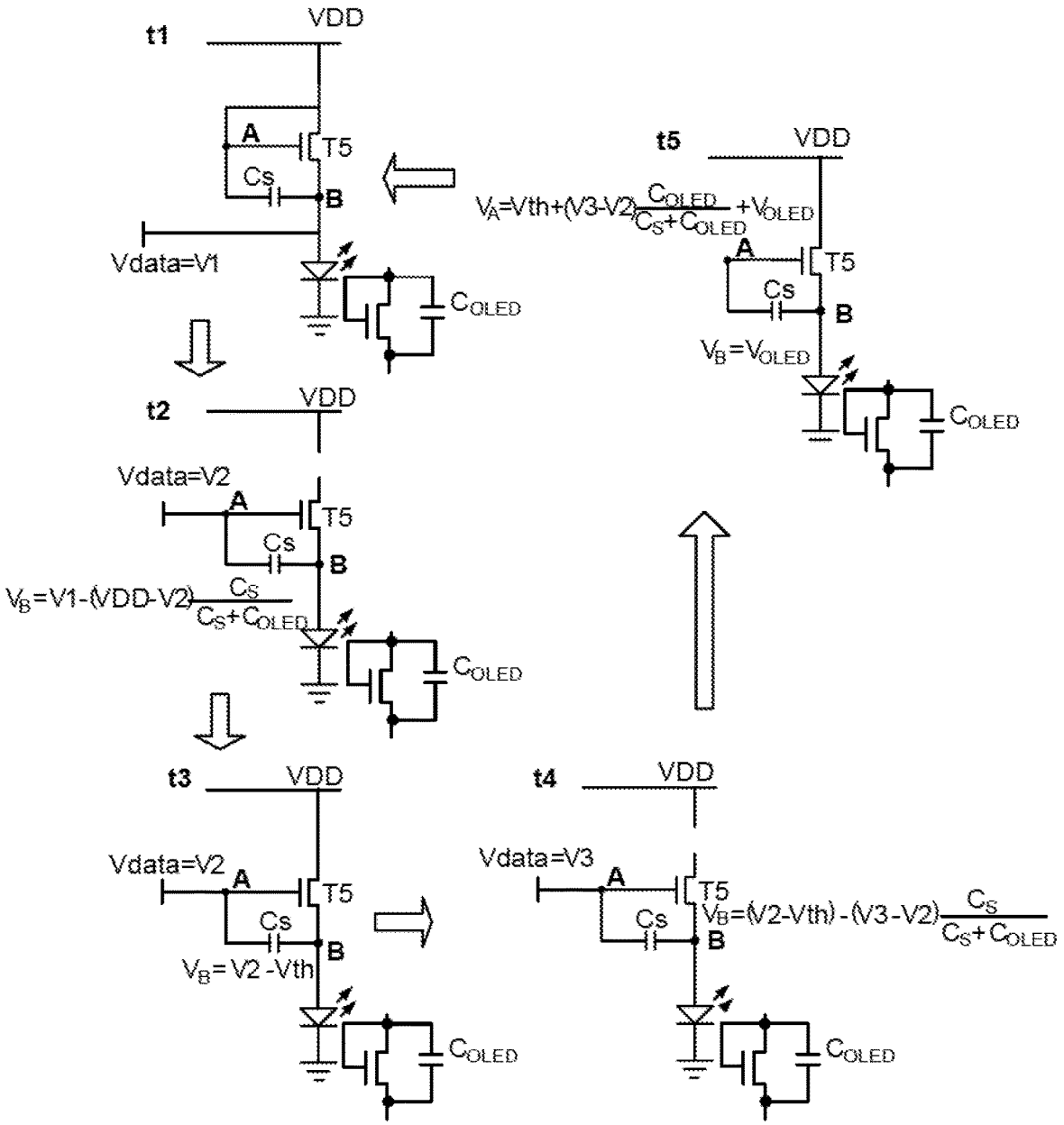
FIG. 5 is a series of effective circuit diagrams respectively corresponding to the pixel driving circuit of FIG. 3 in five periods of one cycle of displaying one frame of pixel image according to an embodiment of the present disclosure.

FIG. 4 is a timing diagram of operating the pixel driving circuit 100 of FIG. 3 with all N-type transistors according to an embodiment of the present disclosure. As shown, the one cycle time is divided into five sequential periods named as t1, t2, t3, t4, and t5. Accordingly, the setup or voltage programming for the first control signal Vscan1, the second control signal Vscan2, the third control signal Vems, and the data voltage Vdata is provided in each period. FIG. 5 is a series of effective circuit diagrams respectively corresponding to the pixel driving circuit of FIG. 3 in five periods, t1, t2, t3, t4, and t5 of one cycle of displaying one frame of pixel image according to the embodiment of the present disclosure. Combining the timing diagram showing five periods of one cycle in FIG. 4 and effective circuit in each of the five periods of one cycle in FIG. 5, the method can be illustrated as following. In this example, all transistors in the pixel driving circuit 100 are N-type transistors.

Referring to FIG. 4, starting from each cycle, a first period is an inversion recovery period t1. In this period, the first control signal Vscan1 is set to a low voltage level corresponding to a turn-off voltage level. The first transistor T1 thus is closed or turned off. The third control signal Vems is set to a high voltage level corresponding to a turn-on voltage level to turn on the fourth transistor T4. The second control signal Vscan2 is set to a high voltage level, corresponding to a turn-on voltage level. Thus, the second transistor T2 and the third transistor T3 are turned on. The data voltage Vdata supplied to the data line is programmed to a first voltage level V1. In this embodiment, V1 is given as a negative voltage relative to ground, i.e., V1<0. Referring to first part of FIG. 5. the power supply line is provided with a positive power supply voltage VDD. Since the second transistor T2 and the fourth transistor T4 are turned on, the first node A is connected through both T2 and T4 to the power supply line to make the voltage level at the first node A equal to the power supply voltage VDD, i.e, $V_A$=VDD. Since the third transistor T3 is turned on, the first voltage level of Vdata is written from the data line to the second node B, i.e., $V_B$=V1<0. Because the anode of the OLED is connected to the second node B and the cathode of the OLED is configured to be provided with a common voltage (e.g., grounded) so that the anode voltage of the OLED is lower than the cathode voltage. Therefore, in this inversion recovery period t1, the OLED device is set to a state with inverted polarity with its cathode potential level is higher than that of the anode. The purpose of making the OLED into the inverted polarity state is to reduce buildup of ionic impurity charges within organic layer so that the device's performance will not deteriorate fast with time as it is often being under a positive polarity during its application.

Referring to FIG. 4, sequentially following the inversion recovery period the cycle includes a voltage adjustment period t2. In this period, the second control signal Vscan2 is firstly reset to the turn-off (low) voltage level to turn off the second transistor T2 and the third transistor T3. This makes the two electrodes or two terminals of the storage capacitor Cs in floating state, maintaining charges stored therein unchanged.

Slightly after the resetting of the second control signal Vscan2, the data voltage Vdata supplied to the data line is changed to a second voltage level V2 which is programmed to be higher than the first voltage level V1 but still a negative voltage, i.e., V1<V2<0.

Slightly after the second control signal Vscan2 is firstly reset to the turn-off (low) voltage level, the first control signal Vscan1 is reset to a turn-on (high) voltage level to turn on the first transistor T1. Thus the first node A is written with the voltage level of the Vdata in this period, i.e., V2. In other words, the voltage level at the first node A is changed from VDD to V2, i.e., $V_A$=V2. Since the charges in the capacitor Cs is conserved, with the change of the voltage level at the first node A (a first electrode of the capacitor Cs), the voltage level, at the second node B (a second electrode of the capacitor Cs) will be changed too based on a charge-coupling effect.

Referring to the second part of FIG. 5, the storage capacitor Cs is coupled with an effective capacitor Coled of the OLED in series via the second node B anode of the OLED) and the cathode of the OLED is configured to be provided with a common voltage or simply grounded. Thus the voltage level at the second node B will be changed to $$V_B = V1 - (VDD - V2)\frac{C_s}{C_s + C_{oled}}.$$

In this period, the third control signal Vems is switched to a turn-off (lour) voltage level to turn the fourth transistor T4 off. As the first voltage level V1 and the second voltage level V2 are both negative voltage, $V_B$ in this period is also a negative voltage. Optionally, the values of V1 and V2 as well as the capacitances of the storage capacitor Cs and the effective capacitor Coled of OLED are selected to make the absolute value of $V_B$ to be greater than the absolute value of a first threshold voltage Vth of the driving transistor T5.

Referring to FIG. 4 again, sequentially following the voltage adjustment period the cycle includes a threshold-voltage latch period t3. In this period. the first control signal Vscan1 remains to be at the high voltage level to keep the first transistor T1 on. The second control signal Vscan2 remains to be at the turn-off (low) voltage level to keep the second transistor T2 and the third transistor T3 off Now, the first node A remains in a floating state with a voltage level at $V_A$=V2. The third control signal Vems is reset to the turn-on (high) voltage level to turn the fourth transistor T4 on. Referring to third part of FIG. 5, the fourth transistor T4 at the ON state connects the power supply line to the drain electrode of the fifth transistor T5 and the gate electrode of the fifth transistor T5 is connected to the first node A. Therefore, the power supply voltage VDD is passed to the gate electrode and the drain electrode of the fifth transistor T5 to charge the source electrode of the fifth transistor T5 to increase its voltage level. The charging effect continues until the source node voltage $V_B$ is reached to $V_A$−Vth=V2−Vth.

The charging process of the fifth transistor T5 described above requires that the voltage level at the source node $V_B$ to satisfy the following relation:

$$|V_B| = \left| V1 - (VDD - V2)\frac{C_s}{C_s + C_{oled}} \right| > |Vth|.$$

Here, Vth is the first threshold voltage associated with the driving transistor T5. The source electrode of the fifth transistor T5 is coupled to the second node B, so that the voltage level at the second node B after the charging process ends will be $V_B$=V2−Vth. Effectively, the threshold voltage Vth of the driving transistor T5 is latched into the storage capacitor Cs. In order to avoid unnecessary light emission of the OLED in entire cycle (in any periods other than emission period), the anode of the OLED, which is the second node B, should be kept at a voltage level $V_B$ to satisfy the following relation:

$$V_B = \left| V1 - (VDD - V2)\frac{C_s}{C_s + C_{oled}} \right| < |V_{th_oled}|.$$

Here, $V_{th_oled}$ is a second threshold voltage associated with the OLED device (coupled to the pixel driving circuit 100).

Referring to FIG. 4, sequentially following the threshold-voltage latch period the cycle includes a data-voltage input period t4. In this period, the third control signal Vems is reset to the turn-off (low) voltage level to turn off the fourth transistor T4 to cut off the connection of the drain electrode of the driving transistor T5 with the power supply line. The second control signal Vscan2 remains at the turn-off (low) voltage level to keep the second transistor T2 and the third transistor T3 off. The first control signal Vscan1 remains at the turn-on (high) voltage level to keep the first transistor T1 on, so that any voltage change in data line will be written to the first node A.

Slightly after the third control signal being reset to the low voltage level, the data voltage Vdata is supplied a third voltage level V3 to the data line which is programmed to be a positive voltage and is written to the first node A. Referring to a fourth part of FIG. 5, the data voltage V3 is a voltage corresponding to a real image data corresponding to a certain intensity of the light emission by the OLED associated with the subpixel in the display panel. The voltage level at the first node A now is changed from V2 to V3, i.e., $V_A$=V3. At the same time, the voltage level $V_B$ at the second node B is also changed from V2−Vth to $$(V2 - Vth) - (V3 - V2)\frac{C_s}{C_s + C_{oled}}$$

due to a coupling effect of the Cs connected in series with Coled. The voltage difference across the storage capacitor Cs then is:

$$V_A - V_B = V_3 - \left[(V_2 - V_{th}) - (V_3 - V_2)\frac{C_s}{C_s + C_{oled}}\right] = V_{th} + (V_3 - V_2)\left(1 + \frac{C_s}{C_s + C_{oled}}\right) = V_{th} + (V_3 - V_2)\left(\frac{2C_s + C_{oled}}{C_s + C_{oled}}\right).$$

Referring to FIG. 4 again, sequentially following the data-voltage input period the cycle includes an emission period t5. In this period, the second control signal Vscan2 is kept at the turn-off (low) voltage level to keep the second transistor T2 and the third transistor T3 off. The third control signal Vems is reset to the turn-on (high) voltage level to turn the fourth transistor T4 on. Slightly ahead of the third control signal Vems is changed to the high voltage level, the first control signal Vscan1 is reset to the turn-off (low) voltage level to turn the first transistor T1 off to avoid competition.

Referring to a fifth part of FIG. 5, the first node A, which, is connected to the gate electrode of the driving transistor T5, remains at $V_A$=V3. The second node B is connected to the anode of the OLED, i.e., $V_B$=Voled. The storage capacitor. Cs continues to maintain a gate-source voltage of the driving transistor T5 to be:

$$Vgs = V_A - V_B = Vth - (V3 - V2)\frac{C_{oled}}{C_s + C_{oled}}$$

until a next cycle starting with an inversion recovery period in which the OLED polarity is inverted. The driving transistor T5 works in a saturation state to generate a driving current that directly flows to the anode of the OLED as a driving current $I_{oled}$ to drive light emission of the OLED.

The driving current $I_{oled}$ generated by the driving transistor can be expressed as:

$$I_{oled} = \beta(V_{gs} - V_{th})^2 = \beta\left(V_{th} + (V_3 - V_2)\left(1 + \frac{C_s}{C_s + C_{oled}}\right) - V_{th}\right)^2 = \beta\left((V_3 - V_2)\left(1 + \frac{C_s}{C_s + C_{oled}}\right)\right)^2 = \beta\left((V_3 - V_2)\left(\frac{2C_s + C_{oled}}{C_s + C_{oled}}\right)\right)^2; \quad (2)$$

where $$\beta = \frac{1}{2}\mu_n C_{OX}\frac{W}{L},$$

$\mu_n$ is an electron carrier mobility of the driving transistor T5, Cox is an insulation capacitance of a unit area, W/L is a width-to-length ratio of the driving transistor T5. As seen in formula (2), the driving current $I_{oled}$ in the emission period is independent of the first threshold voltage Vth of the driving transistor and the second threshold voltage Vth_oled of the OLED. The capacitances for the storage capacitor Cs and the effective capacitor Coled associated with the OLED are substantially constants determined by the display panel manufacture process. Therefore, the driving current $I_{oled}$ is only affected by the inputted data voltage Vdata which, in this example, is programmed to be the second voltage level V2 during an voltage adjustment period and a threshold-voltage latch period of each cycle and the third voltage level V3 during the data-voltage input period of each cycle. Thus, the method proposed above is able to operate the 5T1C pixel driving circuit (100 of FIG. 3) to effectively compensate drift of threshold voltages (including both Vth and Vth_oled) in addition to invert polarity of the OLED during at least an inversion recovery period of each cycle to slow down OLED deterioration rate.

Figure 6:
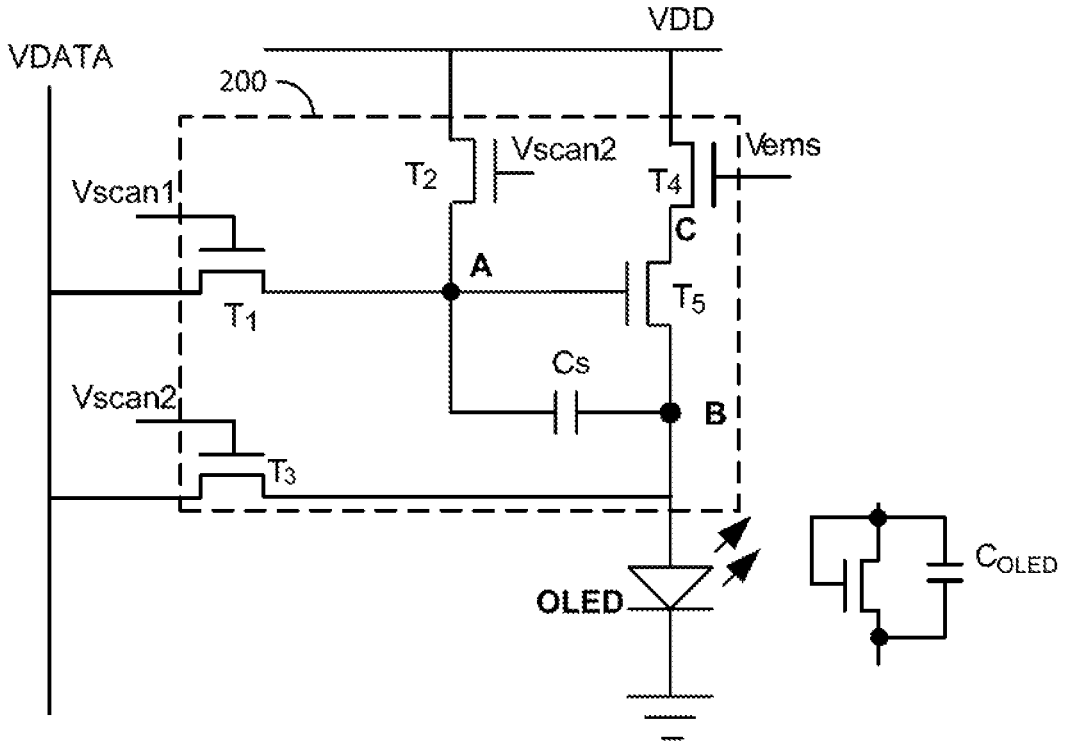
FIG. 6 is a pixel driving circuit comprising a 5T1C structure according to another embodiment of the present disclosure.

FIG. 6 shows a pixel driving circuit comprising a 5T1C structure according to another embodiment of the present disclosure. Referring to FIG. 6, the pixel driving circuit 200 includes an input sub-circuit substantially similar to the input sub-circuit 10 of FIG. 2, an adjust sub-circuit having slightly different connection compared with the adjust sub-circuit 12 of FIG. 2, a charge sub-circuit substantially similar to the charge sub-circuit 14 of FIG. 2, a drive sub-circuit and a storage sub-circuit substantially the same as the drive sub-circuit 16 and the storage sub-circuit 18 of FIG. 2. In this embodiment, the adjust sub-circuit also includes two transistors: a second transistor T2 and a third transistor T3. The second transistor T2 has a gate electrode coupled to a second scan line, a drain electrode coupled to a power supply line, and a source electrode coupled to the first node A. The second transistor T2 is a switch transistor for connecting the power-supply line to pass a power supply voltage VDD to set or adjust the voltage level at the first node A under control of a second control signal Vscan2 supplied to the second scan line. The third transistor T3 has a gate electrode also coupled to the second scan line, a drain electrode coupled to the data line Vdata, and a source electrode coupled to the second node B. The third transistor T3 is also a switch transistor for connecting the data line Vdata to set or adjust a voltage level at the second node B under control of the second control signal Vscan2 from the second scan line. Except that the second transistor T2 of the pixel driving circuit 200 has a different circuitry connection of its drain electrode comparing to that in the pixel driving circuit 100 of FIG. 3, all other circuitry connections of other transistors T1, T3, T4, and T5 as well as the capacitor Cs are the same as the pixel driving circuit 100.

Figure 7:
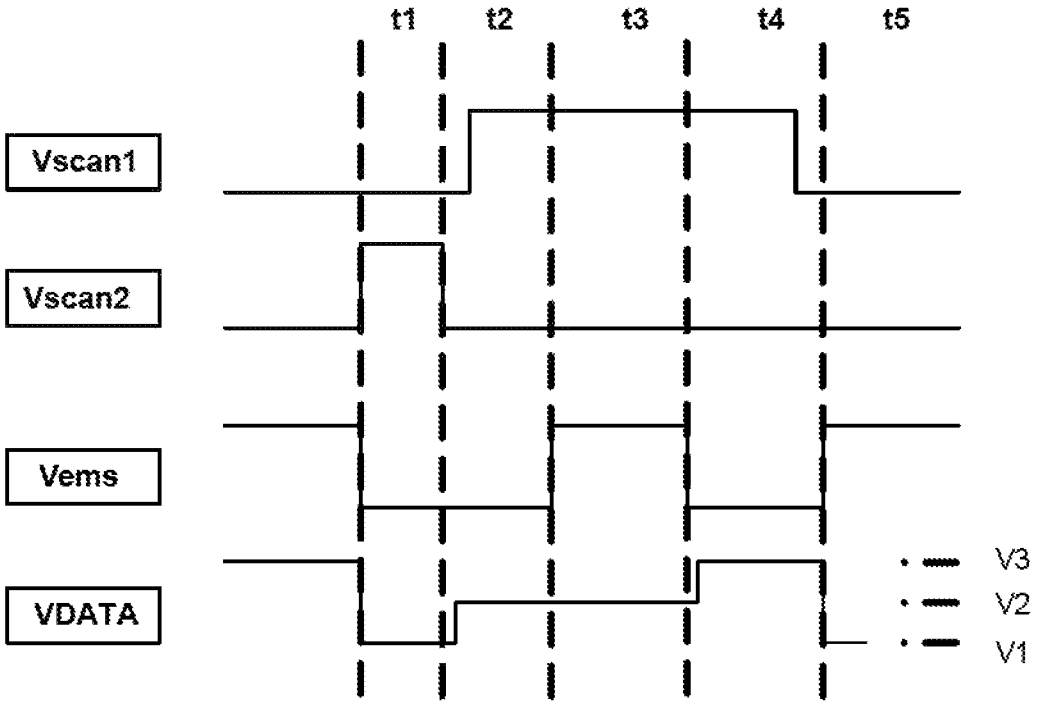
FIG. 7 is a timing diagram of operating the pixel driving circuit of FIG. 6 with all N-type transistors according to an embodiment of the present disclosure.

FIG. 7 is a timing diagram of operating the pixel driving circuit 200 of FIG. 6 according to an embodiment of the present disclosure. As shown, the one cycle time is divided into five sequential periods named as t1, t3, t4, and t5. Accordingly, the setup or voltage programming for the first control signal Vscan1, the second control signal Vscan2, the third control signal Vems, and the data voltage Vdata is provided in each period.

Referring to FIG. 7, starting from each cycle, a first period is an inversion recovery period t1. In this period, the first control signal Vscan1 is set to a low voltage level corresponding to a transistor turn-off voltage. The first transistor T1 thus is closed or turned off. The third control signal Vems is also set to the low voltage level to turn off the fourth transistor T4. The second control signal Vscan2 is set to a high voltage level corresponding to a transistor turn-on voltage. Thus, the second transistor T2 and the third transistor T3 are turned on. The data voltage Vdata supplied to the data line is programmed to a first voltage level V1. In this embodiment, V1 is given as a negative voltage relative to ground, i.e., V1<0. Referring to first part of FIG. 5, the power supply line is provided with a fixed positive power supply voltage VDD. Since the second transistor T2 is turned on, the first node A is connected to the power supply line to make the voltage level at the first node A equal to the power supply voltage VDD, $V_A$=VDD. Since the third transistor T3 is turned on, the first voltage level is written to the second node B, i.e., $V_B$=V1. Because the anode of the OLED is connected to the, second node B and the cathode of the OLED is grounded, $V_B$<0. Therefore, in this inversion recovery period t1, the OLED device is set to a state with inverted polarity with its cathode potential level is higher than that of the anode. The purpose of making the OLED into the inverted polarity state is to reduce buildup of ionic impurity charges within organic layer so that the device's performance will not deteriorate fast with time as it is often being under a positive polarity during its application.

Referring to FIG. 4 and FIG. 7, starting from the second period, the voltage adjustment period t2, the timing waveforms in FIG. 7 for all the control signals, Vscan1, Vscan2, Vems, as well as the data signal Vdata are substantially the same as those in FIG. 4. The operation of the pixel driving circuit 200 of FIG. 6 thus is substantially the same as operation of the pixel driving circuit 100 of FIG. 3.

Figure 8:
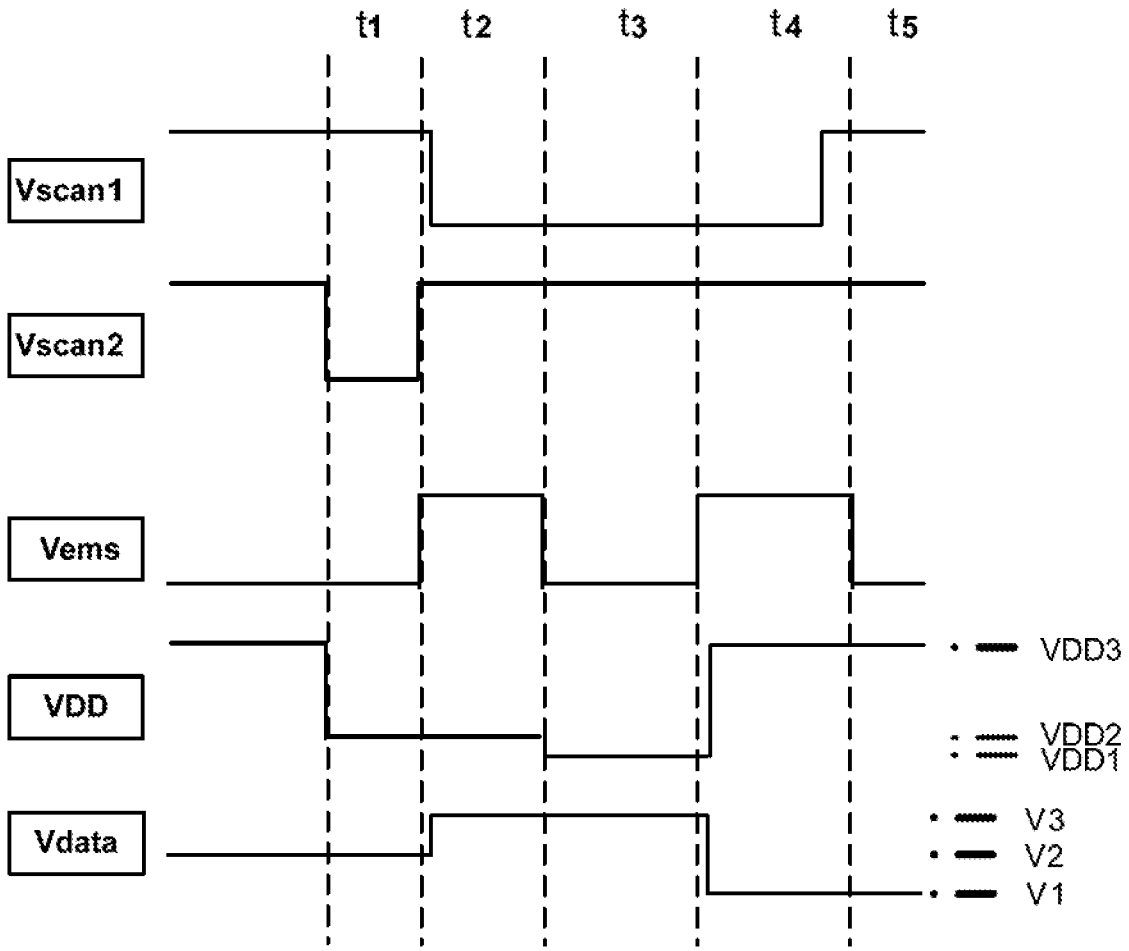
FIG. 8 is a timing diagram of operating the pixel driving circuit of FIG. 3 with all P-type transistors according to an embodiment of the present disclosure.

In another alternative embodiment, the pixel driving circuit 100 of FIG. 3 can be provided with all P-type transistors. FIG. 8 is a timing diagram of operating the pixel driving circuit of FIG. 3 with all P-type transistors according to an embodiment of the present disclosure. Referring to FIG. 8, in the first period t1, i.e., an inversion recovery period, the first control signal Vscan1 is provided with a turn-off (high) voltage level to turn off the first transistor T1. The third control signal Vems is provided with a turn-on (low) voltage level to turn on the fourth transistor T4. The second control signal Vscan2 is set to a turn-on (low) voltage level to turn on both the second transistor T2 and the third transistor T3. The power supply voltage from the power supply line is given at VDD2, which is passed via T4 and T2 to the first node A, i.e., $V_A$=VDD2. The data voltage Vdata=V2 is written via T3 to the second node B, i.e., $V_B$=V2. V2 is given a negative voltage (V2<0). Optionally, VDD2 is set to be smaller than V2 to allow the fifth transistor T5 open. The anode voltage of the OLED is $V_B$. The cathode voltage of the OLED is grounded. $V_B$<0, so, the OLED is set to an inverted polarity state in the inversion recovery period. This helps to clear residue charges built up during its operation of the OLED to recover its physical characteristics with prolonged lifetime.

Referring to FIG. 8, in a next period t2, i.e., voltage adjustment period, the second control signal Vscan2 is set to a turn-off (high) voltage level to turn off T2 and T3. The third control signal Vems is also set to the turn-off voltage level to turn off T4, making two terminals (i.e., first node A and the second node B) of the capacitor Cs in floating state to preserve charges stored therein. Then, slightly after setting the third control signal Vems to the turn-off voltage level, the first control signal Vscan1 is set to the turn-on (low) voltage level to turn on T1, changing the voltage level of the first node A to $V_A$=V3>V2. According to a coupling effect of the capacitor Cs as well as an effective capacitor Coled associated with the OLED, the voltage level of the second node B becomes $V_B$=V2−(VDD2−V3)Cs/(Cs+Coled).

Referring to FIG. 8, in a next period t3, i.e., a threshold-voltage latch period, the first control signal Vscan1 remains at the turn-on (low) voltage level so that T1 is kept on. The third control signal Vems is changed to the turn-on (low) voltage level to turn T4 on. The first node A remains at the voltage level of V3. In this period, the power supply voltage jumps to VDD1<VDD2. Optionally, the value of VDD1 is set to VDD1<V3<$V_B$=V2−(VDD2−V3)Cs/(Cs+Coled). The anode voltage $V_B$ of the OLED be charged by the power supply voltage through T4 and T5. The charging effect continues until the voltage level of the source electrode of the fifth transistor T5, i.e., the second node B, to reach a value of V3+Vth, here Vth is the first threshold voltage associated with the fifth transistor T5 (P-type). Accordingly, this first threshold voltage Vth is latched into the capacitor Cs. Note, the charging and latching process is in effect only with the following condition being satisfied:

$$|V_B| = \left| V2 - (VDD2 - V3)\frac{C_s}{C_s + C_{oled}} \right| > |Vth|.$$

Referring to FIG. 8 in a next period t4, i.e., a data-input period, the first control signal Vscan1 is retained to be the turn-on (low) voltage level to keep T1 on. The third control signal Vems is set to the turn-off (high) voltage level to turn off T4. The power supply voltage VDD jumps to VDD3>VDD2. The data voltage, now at a different voltage level V1 is inputted to the first node A, i.e., $V_A$=V1. Then, the coupling effect causes the voltage level of the second node B to be changed to $V_B$=(V3+Vth)+(V1−V3)Cs/(Cs+Coled). The voltage stored in the capacitor Cs will be retained at:

$$V1 - V_B = [(V3 + Vth) + (V1 - V3)Cs/(Cs + Coled)] = -Vth + (V1 - V3)Coled/(Cs + Coled).$$

In order to avoid unnecessary light emission during each cycle (except in a designed emission period), the voltage level of the anode or the second node B should be kept at $V_B$<Vth_oled, here Vth_oled is an anode voltage when the OLED starts to emit light, which is also defined as a second threshold voltage described in earlier sections of this disclosure.

Referring to FIG. 8 again, in a next period t5, i.e., an emission period, the second control signal Vscan2 is kept at the turn-off (high) voltage level to keep T2 and T3 off while the first control signal Vscan1 is changed to the turn-off (high) voltage level to turn off T1. The third control signal Vems is changed to the turn-on (low) voltage level to turn on T4. Here, setting the first control signal Vscan1 to the turn-off voltage level is performed earlier than setting the third control signal Vems to the turn-on voltage level to avoid competition. In this period, the OLED is driven by a driving current from the fifth transistor T5 to emit light. T5 is working in a saturation state as the second node B has its voltage level $V_B$=Voled. The capacitor Cs continues to maintain a gate-to-source voltage Vgs as:

$$Vgs = -Vth + (V1 - V3)Coled/(Cs + Coled)$$

The driving current $I_{oled}$ generated by the driving transistor T5 (P-type) can be expressed as:

$$I_{oled} = \beta(V_{gs} - (-Vth))^2 = \beta\left(-Vth + (V1 - V3)\frac{C_{oled}}{C_s + C_{oled}} - (-Vth)\right)^2 = \beta\left((V1 - V3)\frac{C_{oled}}{C_s + C_{oled}}\right)^2. \quad (3)$$

As shown in formula (3), the driving current through the OLED during the emission period is independent of the first threshold voltage Vth of the driving transistor T5 and the second threshold voltage Vth_oled of the OLED. The driving current only is affected by the inputting data voltage Vdata, which is programmed in different levels in different periods in each cycle.

In yet another alternative embodiment, the pixel driving circuit 200 of FIG. 6 can be provided with all P-type transistors. Correspondingly, a timing diagram of operating the pixel driving circuit 200 of FIG. 6 with all P-type transistors can be provided by modifying only the first period t1 of FIG. 8 to have the third control signal Vems being provided with a turn-off (high) voltage level to turn off the fourth transistor T4 while other control signals are provided the same as those in FIG. 8. The power supply voltage from the power supply line is given at VDD2, which is passed via the T2 to the first node A, i.e., $V_A$=VDD2. The data voltage Vdata=V2 is written via T3 to the second node B, i.e., $V_B$=V2. V2 is given a negative voltage (V2<0). Optionally, VDD2 is set to be smaller than V2 to allow the fifth transistor T5 open. The anode voltage of the OLED is $V_B$. The cathode voltage of the OLED is grounded $V_B$0, so, the OLED is set to an inverted polarity state in the inversion recovery period. This helps to clear residue charges built up during its operation of the OLE tea recover its physical characteristics with prolonged lifetime. For all other periods t2, t3, t4, and t5 in this example, all the control signals are provided the same as those in FIG. 8. Thus the corresponding operation of the pixel driving circuit 200 with all P-type transistors in those periods will be the same as those shown before.

In another aspect, the present disclosure provides a display apparatus including a display panel and a pixel driving circuit described herein. In an example, the pixel driving circuit in the display apparatus is substantially the same as the pixel driving circuit 100 shown in FIG. 2, or as a specific embodiment in FIG. 3, including five transistors and one capacitor as a basic structure coupled with a data line, a first scan line, a second scan line, a control line, and a power supply line. Each of the five transistors is an N-type transistor. Optionally, each of the five transistors is a P-type transistor. In another example, the pixel driving circuit in the display apparatus is substantially the same as the pixel driving circuit 200 shown in FIG. 6, including five transistors and one capacitor as a basic structure coupled with a data line, a first scan line, a second scan line, a control line, and a power supply line. Optionally, each of the five transistors is an N-type transistor. Optionally, each of the five transistors is a P-type transistor. The pixel driving circuit is one of a plurality of unit circuits coupled to an anode of a light-emitting device associated with one of a plurality of subpixels in the display panel. Optionally, the light-emitting device is an organic light-emitting diode having a cathode configured to be provided with a common voltage (e.g., being grounded). Optionally, the display panel is an organic light-emitting diode display panel. Examples of appropriate display apparatuses include, but are not limited to, an electronic paper, a mobile phone, a tablet computer, a television, a monitor, a notebook computer, a digital album, a GPS, etc. In one example, the display apparatus is a smart watch. Optionally, the display apparatus is an organic light emitting diode display apparatus.

The foregoing description of the embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to exemplary embodiments of the invention does not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A pixel driving circuit for driving light emission in a display panel comprising:

an input sub-circuit configured to set a voltage level at a first node based on a data voltage;

a storage sub-circuit coupled between the first node and a second node to maintain a voltage difference;

a drive sub-circuit coupled to the first node and the second node, the drive sub-circuit being configured to provide a drive current via the second node to a light-emitting device in the display panel to drive light emission in one of multiple periods of each cycle of displaying a frame of pixel image;

a charge sub-circuit coupled to the drive sub-circuit, and configured to charge the drive sub-circuit to latch a voltage level at the second node to be larger than a first threshold voltage but smaller than a second threshold voltage;

an adjust sub-circuit coupled to the second node and coupled to the input sub-circuit at least via the first node, and configured to at least adjust voltage level at the second node to make the light-emitting device with an inverted polarity in one of multiple periods of each cycle of displaying a frame of pixel image.

2. The pixel driving circuit of claim 1, wherein the input sub-circuit comprises a first transistor coupled between a data line and the first node under control of a first control signal from a first scan line;

the adjust sub-circuit comprises a second transistor coupled between a third node and the first node under control of a second control signal from a second scan line and a third transistor coupled between the data line and the second node under control of the second control signal;

the charge sub-circuit comprises a fourth transistor coupled to a power supply line and the third node under control of a third control signal from a control line;

the drive sub-circuit comprises a fifth transistor coupled to the third node and the second node under control of a voltage level at the first node; and the storage sub-circuit comprises a capacitor coupled between the first node and the second node;

wherein the second node is connected to an anode of the light-emitting device.

3. The pixel driving circuit of claim 2, wherein the first transistor comprises a gate electrode coupled to the first scan line, a drain electrode coupled to the data line, and a source electrode coupled to the first node;

the second transistor comprises a gate electrode coupled to the second scan line, a drain electrode coupled to the third node, and a source electrode coupled to the first node;

the third transistor comprises a gate electrode coupled to the second scan line, a drain electrode coupled to the data line, and a source electrode coupled to the second node;

the fourth transistor comprises a gate electrode coupled to the control line, a drain electrode coupled to the power supply line, and a source electrode coupled to the third node; and the fifth transistor comprises a gate electrode coupled to the first node, a drain electrode coupled to the third node, and a source electrode coupled to the second node.

4. The pixel driving circuit of claim 1, wherein the first threshold voltage is a transistor threshold voltage in the driving sub-circuit and the second threshold voltage is an emission threshold voltage of the light-emitting device.

5. The pixel driving circuit of claim 1, wherein the light-emitting device is an organic light-emitting diode.

6. A display apparatus comprising a display panel and the pixel driving circuit of claim 1.

7. The display apparatus of claim 6, wherein the pixel driving circuit comprises a data line, a first scan line, a second scan line, a control line, a power supply line;

the input sub-circuit comprises a first transistor coupled between the data line and the first node under control of a first control signal from the first scan line;

the adjust sub-circuit comprises a second transistor coupled between a third node and the first node under control of a second control signal from the second scan line and a third transistor coupled between the data line and the second node under control of the second control signal;

the charge sub-circuit comprises a fourth transistor coupled to the power supply line and the third node under control of a third control signal from the control line;

the drive sub-circuit comprises a fifth transistor coupled to the third node and the second node under control of a voltage level at the first node; and the storage sub-circuit comprises a capacitor coupled between the first node and the second node;

wherein the second node is connected to an anode of the light-emitting device.

8. The display apparatus of claim 7, wherein the first transistor comprises a gate electrode coupled to the first scan line, a drain electrode coupled to the data line, and a source electrode coupled to the first node;

the second transistor comprises a gate electrode coupled to the second scan line, a drain electrode coupled to the third node, and a source electrode coupled to the first node;

the third transistor comprises a gate electrode coupled to the second scan line, a drain electrode coupled to the data line, and a source electrode coupled to the second node;

the fourth transistor comprises a gate electrode coupled to the control line, a drain electrode coupled to the power supply line, and a source electrode coupled to the third node; and the fifth transistor comprises a gate electrode coupled to the first node, a drain electrode coupled to the third node, and a source electrode coupled to the second node.

9. The display apparatus of claim 7, wherein each of the first transistor, the second transistor, the third transistor, the fourth transistor and the fifth transistor is a same type, either an N-type transistor or a P-type transistor.

10. The display apparatus of claim 6, wherein the display panel is an organic light-emitting diode display panel, and the light-emitting device is an organic light-emitting diode.

11. The pixel driving circuit of claim 1, wherein the input sub-circuit comprises a first transistor coupled between a data line and the first node under control of a first control signal from a first scan line;

the adjust sub-circuit comprises a second transistor coupled between a power supply line and the first node under control of a second control signal from a second scan line and a third transistor coupled between the data line and the second node under control of the second control signal;

the charge sub-circuit comprises a fourth transistor coupled to the power supply line and a third node under control of a third control signal from a control line;

the drive sub-circuit comprises a fifth transistor coupled to the third node and the second node under control of a voltage level at the first node; and the storage sub-circuit comprises a capacitor coupled between the first node and the second node;

wherein the second node is connected to an anode of the light-emitting device.

12. The pixel driving circuit of claim 11, wherein the first transistor comprises a gate electrode coupled to the first scan line, a drain electrode coupled to the data line, and a source electrode coupled to the first node;

the second transistor comprises a gate electrode coupled to the second scan line, a drain electrode coupled to the power supply line, and a source electrode coupled to the first node;

the third transistor comprises a gate electrode coupled to the second scan line, a drain electrode coupled to the data line, and a source electrode coupled to the second node;

the fourth transistor comprises a gate electrode coupled to the control line, a drain electrode coupled to the power supply line, and a source electrode coupled to the third node; and the fifth transistor comprises a gate electrode coupled to the first node, a drain electrode coupled to the third node, and a source electrode coupled to the second node.

13. A method of driving a light-emitting element associated with a subpixel of a display panel to emit light in one cycle for displaying one frame of pixel image, comprising:

setting a voltage level at an anode of the light-emitting element to be lower than that at a cathode of the light-emitting element to make the light-emitting element with inverted polarity;

adjusting the voltage level to be greater than an absolute value of a first threshold voltage of a driving transistor coupled to the anode but smaller than a second threshold voltage of the light-emitting element;

charging the anode to change the voltage level at the anode based on the first threshold voltage;

updating the voltage level at the anode based on an input data voltage to further subtract a coupling voltage resulting from a fixed capacitor connected in series with an effective capacitor associated with the light-emitting element; and generating a driving current through the driving transistor that is independent from the first threshold voltage and the second threshold voltage to drive light emission of the light-emitting element.

14. The method of claim 13, further comprising operating a pixel driving circuit coupled to the anode of the light-emitting element to drive light emission of the light-emitting element in one cycle including, sequentially, an inversion recovery period, a voltage adjustment period, a threshold-voltage latch period, a data-voltage input period, and an emission period, the pixel driving circuit comprising, a data line;

a first scan line;

a second scan line;

a control line;

a power supply line;

a capacitor coupled between a first node and a second node, the second node being coupled to the anode of the light emitting element;

a first transistor coupled between the data line and the first node, the first transistor being under control of a first control signal from the first scan line;

a second transistor coupled between a third node and the first node, the second transistor being under control of a second control signal from the second scan line;

a third transistor coupled between the data line and a second node, the third transistor being under control of the second control signal from the second scan line; and a fourth transistor and a fifth transistor coupled to each other in series via the third node between the power supply line and the second node, the fourth transistor being controlled by a third control signal from the control line and the fifth transistor being the driving transistor controlled by a voltage level at the first node;

generating a voltage level at the second node such as to make the light-emitting element with inverted polarity at least in the inversion recovery period.

15. The method of claim 14, further comprising, in the inversion recovery period, setting the first control signal to a turn-off voltage level to turn off the first transistor;

setting the second control signal to a turn-on voltage level to turn on the second transistor and the third transistor;

setting the third control signal to a turn-on voltage level to turn on the fourth transistor; and supplying a data voltage being a negative level to the data line;

wherein the first node is set to a voltage level from the power supply line and the second node is set to a voltage level of the data voltage.

16. The method of claim 15, further comprising, in the voltage adjustment period following the inversion recovery period, setting the second control signal to the turn-off voltage level to turn off the second transistor and the third transistor;

setting the first control signal to the turn-on voltage level to turn on the first transistor slightly after setting the second control signal to the turn-off voltage level;

keeping the third control signal at the turn-on voltage level to maintain the fourth transistor on; and supplying the data voltage at a different voltage level to the data line slightly after setting the second control signal to the turn-off voltage level.

17. The method of claim 16, further comprising, in the threshold-voltage latch period following the voltage adjustment period, keeping the first control signal to be the turn-on voltage level to keep the first transistor on;

keeping the second control signal to be the turn-off voltage level to turn off the second transistor and the third transistor;

setting the third control signal to the turn-on voltage level to turn on the fourth transistor; and keeping the data voltage unchanged.

18. The method of claim 17, further comprising, in the data-voltage input period following the threshold-voltage latch period, keeping the first control signal to be the turn-on voltage level to keep the first transistor on;

keeping the second control signal to be the turn-off voltage level to keep the second transistor and the third transistor off;

setting the third control signal to the turn-off voltage level to turn off the fourth transistor; and supplying the data voltage with another different voltage level to the data line slightly after setting the third control signal to the turn-off voltage level.

19. The method of claim 18, further comprising, in the emission period following the data-voltage input period, setting the third control signal to the turn-on voltage level to turn on the fourth transistor;

keeping the second control signal to be the turn-off voltage level to keep the second transistor and the third transistor off;

setting the first control signal to the turn-off voltage level to turn off the first transistor slightly ahead of setting the third control signal to the turn-on voltage level to turn on the fourth transistor; and generating a drive current through the fifth transistor via the second node to the anode of the light-emitting element, wherein the drive current is independent of the first threshold voltage and the second threshold voltage.

20. The method of claim 14, wherein each of the first transistor, the second transistor, the third transistor, the fourth transistor and the fifth transistor is a same type, either an N-type transistor or a P-type transistor, and the light-emitting element is an organic light-emitting diode.

* * * * *